US008662719B2

(12) United States Patent
Rohwedder et al.

(10) Patent No.: US 8,662,719 B2
(45) Date of Patent: Mar. 4, 2014

(54) OPERATING LIGHT WITH IMPROVED OPERATING FUNCTIONALITY

(75) Inventors: Björn Rohwedder, Hamburg (DE); Hanno Kretschmann, Hamburg (DE); Sven Müller, Honigsee (DE)

(73) Assignee: Dräger Medical GmbH, Lübeck (DE)

( * ) Notice: Subject to any disclaimer, the term of this patent is extended or adjusted under 35 U.S.C. 154(b) by 278 days.

(21) Appl. No.: 13/071,827

(22) Filed: Mar. 25, 2011

(65) Prior Publication Data

US 2012/0043915 A1 Feb. 23, 2012

(30) Foreign Application Priority Data

Aug. 17, 2010 (DE) ..... 10 2010 034 562

(51) Int. Cl.
*F21V 21/26* (2006.01)
*F21V 23/04* (2006.01)

(52) U.S. Cl.
USPC ..... 362/399; 362/394; 362/287; 362/804

(58) Field of Classification Search
USPC ..... 362/572, 804, 394, 399; 600/249
See application file for complete search history.

(56) References Cited

U.S. PATENT DOCUMENTS

| | | | | |
|---|---|---|---|---|
| 4,316,237 | A | 2/1982 | Yamada et al. | |
| 4,517,632 | A * | 5/1985 | Roos | 362/389 |
| 5,165,786 | A * | 11/1992 | Hubert | 362/287 |
| 5,383,105 | A | 1/1995 | Agut | |
| 5,485,319 | A * | 1/1996 | Lemons | 359/833 |
| 5,669,102 | A * | 9/1997 | Sandel | 16/421 |
| 5,803,905 | A | 9/1998 | Allred et al. | |
| 6,644,837 | B2 * | 11/2003 | Borders et al. | 362/399 |
| 6,863,422 | B2 * | 3/2005 | Jesurun et al. | 362/399 |
| 7,441,923 | B2 * | 10/2008 | Hunnerbein et al. | 362/241 |
| 2003/0210559 | A1 | 11/2003 | Jesurun et al. | |
| 2006/0109664 | A1 | 5/2006 | Hunnerbein et al. | |
| 2007/0278921 | A1 | 12/2007 | Burzele et al. | |
| 2008/0311993 | A1 | 12/2008 | Beutler et al. | |

FOREIGN PATENT DOCUMENTS

| | | | |
|---|---|---|---|
| DE | 32 43 709 | A1 | 5/1984 |
| DE | 100 58 721 | C2 | 6/2002 |
| DE | 102004055838 | A1 | 6/2006 |
| DE | 102004055839 | A1 | 6/2006 |
| DE | 10 2006 025 944 | A1 | 12/2007 |
| DE | 102006025944 | A1 | 12/2007 |
| EP | 1 084 364 | B1 | 3/2001 |
| WO | WO 99/50593 | A2 | 10/1999 |

* cited by examiner

*Primary Examiner* — Peggy A. Neils
(74) *Attorney, Agent, or Firm* — McGlew and Tuttle, P.C.

(57) ABSTRACT

An operating light (1) has a housing (2), which has a light exit opening (4); a holding system, which is coupled with housing (2) and is designed to movably hold the operating light; at least one light source (3) as well as at least one corresponding optical system to direct light emitted by the at least one light source (3) in the direction of light exit opening (4). A grip assembly unit (14) is provided approximately in the middle of light exit opening (4). The grip assembly unit (14) has a handle (5) to pivot the operating light (1) into a desired position. At least one rotating ring (11) is located between the handle (5) and the housing (2) and is rotatable in relation to the handle (5) and is designed to set various functions of operating light (1). As an alternative or in addition, a touch-sensitive sensor element (15), which is designed to set various functions of operating light (1), is located between the handle (5) and the housing (2).

19 Claims, 5 Drawing Sheets

OPERATING LIGHT WITH IMPROVED OPERATING FUNCTIONALITY

CROSS REFERENCE TO RELATED APPLICATIONS

This application claims the benefit of priority under 35 U.S.C. §119 of German Patent Application DE 10 2010 034 562.8 filed Aug. 17, 2010, the entire contents of which are incorporated herein by reference.

FIELD OF THE INVENTION

The present invention pertains to an operating light with a housing, which has a light exit opening, a ceiling arm system, which is coupled with the housing and is designed to movably hold the operating light. The present invention pertains, in particular, to an operating light with a grip assembly unit, by means of which multifunctional operation of the operating light is guaranteed.

BACKGROUND OF THE INVENTION

DE 100 58 721 C2 discloses an operating light arranged movably on a pivotable ceiling arm system with a light source, which is arranged in a light housing and whose light beams are directed by means of a reflector to a light exit area. A handle, which can be grasped with the hand in order to pivot the operating light into the desired position, is provided at the light exit area.

Similar operating lights are known from DE 10 2004 055 838 A1 and DE 10 2004 055 839 A1. These lights have a light housing, in which two light sources and corresponding reflectors are arranged to direct the light emitted by the light sources to a light exit side of the operating light. An outwardly directed, projecting handle, which can be sterilized and is used to pivot the light, is provided on this light exit side. Furthermore, the handle is rotatable and is connected to a relative incremental transducer, which sends an electric signal to a control unit of the operating light to simultaneously adjust the illumination of both light sources.

U.S. Pat. No. 4,316,237 describes an operating light, which is arranged on a pivotable ceiling arm system and has a sterile handle at its light exit opening. This handle is rotatable and is designed to mechanically adjust the focus of the light sources. Furthermore, another rotatable switch, which is directly coupled with a voltage regulator to set the intensity of the light sources, is provided at the outer circumferential edge of the light housing.

An operating light, at the light exit opening of which a handle is provided for pivoting the light, is known from U.S. Pat. No. 5,383,105. The handle is provided with a touch-sensitive element, which is coupled with an electronic circuit, which in turn controls a means for setting the concentration of the light beams emitted by the light sources of the light.

EP 1 084 364 B1 likewise pertains to an operating light with a light source arranged in the housing of the light. A handle is also provided here at the light exit area to pivot the light into the desired position. The handle is provided at its distal end with an actuating means, which is used to set the intensity of the light emitted by the light source.

Finally, US 2003/0210559 A1 shows an operating light mounted movably on a swivel arm with a housing, at the light exit opening of which a handle is provided for pivoting the light. The handle is rotatable and is used to focus the light emitted by the light source located in the light housing. A ring-shaped operating element with a plurality of pushbuttons, by means of which the intensity of the light can be set, is provided between the rotatable handle and a transparent pane at the light exit opening. The handle and operating element are surrounded by a sterile protective cover, which is pushed over the handle and operating element before a surgery and is again removed after a surgery and can then be disposed of. When the handle is rotated, the protective cover rotates together with the handle, and a proximal end of the protective cover slides over the pushbuttons.

Consequently, all operating lights according to the state of the art have a handle to pivot the light mounted on a generally known swivel arm system into the desired position. The handle is preferably arranged centrally in a light exit side of the light and has such a size that it can be easily grasped with the hand. The handle must be sterile and may be operated, in general, by the operating physician or surgeon or by a "sterile" nurse only to prevent contamination of the handle. The handle must therefore be sterilized in a sterilizer. As an alternative, the handle may be covered with a sterile protective hood, which is disposed of after the surgery.

Furthermore, it is known that an actuating element in the form of, for example, a switch may be provided at the handle itself. As an alternative, the handle may be designed as a rotatable handle and coupled with a control element, for example, a potentiometer. For example, the intensity of the light source(s) arranged in the light housing can then be varied by means of such a potentiometer. However, such a rotatable handle can also be used to focus the light source(s) onto the desired operating area by mechanically displacing the light source(s) and/or the corresponding reflector or reflectors or more generally optical systems by means of the rotatable handle.

It is usually desirable to have the ability to set a plurality of functions of the operating light. These include, for example, setting the light intensity, color temperature, red contribution, focusing the light emitted onto a desired operating area or even the adjustment of dimming means to change the outer limits of the illuminated operating area. It is known for this from the state of the art that additional operating units or operating means may be provided, which are arranged, for example, at the outer circumferential area of the light to be able to be operated by the hospital staff. These operating units are not usually sterile and must not therefore be touched by the physician or surgeon. Even if these "outer" operating elements are sterilized, there is a risk that "non-sterile" staff members will accidently come into contact with these elements, as a result of which these could become contaminated.

The provision of an actuating means directly in the handle, as this is known from EP 1 084 364 B1, has the drawback that contaminants, which can be removed with difficulty only to guarantee the necessary sterility, may accumulate in the grooves between the actuating means and handle. The complete grip component with integrated actuating means can be designed as a replaceable part, which is replaced with a new and sterile part after each operation. However, such a solution makes the grip component complicated and above all expensive. As an alternative, the grip component with actuating means integrated in the grip can be protected by a sterile protective cover. However, since the material of such a cover must be relatively thick and stable to make it possible to push the protective cover over the grip component, the operatability of the actuating means located under such a cover is highly prone to failure. Furthermore, an actuating means integrated in the grip component implies the risk of incorrect switchings during the positioning of the operating light when the surgeon firmly grasps the handle with his hand to pivot the light and accidentally activates the actuating means in the process.

The design of the handle as a turning handle, which is proposed in the state of the art, usually leads to undesired instabilities between the light housing and handle. Consequently, the axis of rotation of the grip must be mounted in a complicated and stable manner to withstand the forces applied to the grip, which are necessary for pivoting the entire operating light. Furthermore, only one function can be controlled by turning the handle.

SUMMARY OF THE INVENTION

The basic object of the present invention is therefore to make available an operating light, which is provided with a handle, and which has a plurality of operating elements, which are provided combined in a preferably sterile area of the operating light at the handle or in the vicinity of the handle to improve the operatability of the light and to prevent contamination of the operating elements in this manner. Another object is to bring about a functional separation between the operation and positioning of the operating light. Furthermore, the operation shall be multifunctional and independent from the position (tilted or rotated position) of the light. In addition, the light shall be able to be operated equally by left- and right-handed persons. Finally, a solution shall be found to make it possible to sterilize the handle in a simple manner. Further objects appear for the person skilled in the art from the entirety of the disclosure.

The operating light according to the present invention has a housing, which is designed to be mounted preferably movably on a holding system, especially on a swivel arm system. One or more light sources as well as corresponding optical systems are arranged in the light housing. The light sources and optical systems are designed to direct the light in the direction of a light exit opening of the light. The optical systems may comprise reflectors and/or lens systems. The operating light is usually oriented on the swivel arm system essentially such as to radiate the light, directed downwardly, onto an operating table, so that the light emitted by the operating light radiates, in general, in the vertical direction. The light housing has a housing upper part and a housing lower part, the terms "upper part" and "lower part" referring to the above-described orientation. The light exit opening is provided on the housing lower part and is preferably formed by a transparent pane made of glass or plastic.

A grip assembly unit is provided approximately in the middle of the housing lower part or of the light exit opening. This grip assembly unit comprises essentially a fixed (e.g., nonrotatable) handle of a size that is suitable for being grasped easily with one hand or at least the fingers of a physician or surgeon to pivot the operating light, possibly together with the swivel arm system, into the desired position.

As was explained above, the grip assembly unit, but at least the handle, must be sterile. This can be achieved by providing the handle before surgery with a sterile cover in the form of a cap or protective cover, which can be removed and disposed of after surgery. As an alternative, the grip element of the handle may be designed as a replaceable part. Furthermore, such a grip element can be sterilized by means of a sterilizer.

Furthermore, the handle is connected rigidly and nonrotatably to the light housing. A stable mechanical coupling can therefore be established between the light housing and handle in a simple manner. The handle proper is used exclusively to pivot the operating light according to the present invention, possibly together with the swivel arm system, into a desired position. The handle itself has no operating elements, and an unintended dimming of the luminosity, an unintended focusing of the light sources or adjustment of other functions is avoided when the handle is grasped to pivot the light.

An operating element is located between the handle and the housing. The operating element is for setting one or more functions of the operating light.

The operating element may be a rotatable ring, which is preferably likewise detachable and sterilizable, located above the handle, i.e., between the handle and light housing. This ring is designed, for example, to adjust the brightness of the light or to focus the light sources in a desired manner. The sterile rotating ring has a height of about 20 mm to 50 mm, preferably has a collar at its upper end and is provided, for example, with a plurality of fluted recessed grips or other gripping elements, for example, knobs, arranged on the outer surface, to be better able to be rotated with the fingers of the user. A rotating ring can thus be operated or rotated both by a right-handed person and a left-handed person from all sides. Furthermore, the rotating ring adjoins with its lower end the upper end of the nonrotatable handle and is mounted rotatable in relation to the handle about the axis thereof. The rotating ring has, for example, an inner passage opening, through which the nonrotatable axle of the handle extends, which axle is rigidly coupled on its side facing away from the handle with the light housing. In addition, the inner surface of the passage opening is preferably provided with a profile to mesh with a correspondingly shaped profile of a tubular actuating element. The tubular actuating element consequently extends concentrically between the axle of the handle and the passage opening of the rotating ring, meshes with the rotating ring, rotating therewith in unison, but is rotatable relative to the stationary axle of the handle. The tubular actuating element is coupled, for example, with a potentiometer, a relative incremental transducer or a right and left button or a similar measuring transducer, which is designed to convert a rotation of the rotating ring and hence of the actuating element into a corresponding electric signal.

In a possible embodiment, rotation of the rotating ring to the right (clockwise) brings about an increase in the luminosity of the light source(s), whereas rotation to the left (counterclockwise) brings about a reduction of the luminosity. The operating light can be switched off by a rotation to the left beyond a noticeable resistance. The light is then switched on again by a subsequent rotation to the right. As an alternative, it is possible, for example, that the rotating ring is not coupled with a potentiometer or a similar measuring transducer for detecting an angle of rotation. The rotating ring can be rotated, instead, by a relatively small angle to the right and left against a stop (preferably against a small mechanical resistance to rotation) to perform individual "clicks" in the right and left directions. This means that a short rotation to the left against a left-hand stop brings about a "click," as a result of which the luminosity is reduced, for example, by a small incremental value. One or more short rotations against the right-hand stop do consequently bring about one or more "right clicks," as a result of which the luminosity is increased by small incremental values each time. These "clicks" are preferably acknowledged by acoustic signals. The above-described alternative has, among other things, the advantage that the rotating ring is always in the zero position after switching off or after switching on. It is obvious that focusing of the operating light or even other functions can also be performed as an alternative by rotating the rotating ring. A menu control is likewise possible due to a built-in double-click functionality, as it will be described below.

Another advantage of the present invention is that the handle can be pulled off from the grip axle and rotating ring from the profile of a tubular actuating element to be sterilized in an autoclave after a surgery.

Another preferred embodiment of the present invention is based on the operating element located between the handle and the housing being based on a capacitive "touch" operation. The operating light is operated via a ring-shaped sensor element, which is provided either separately from the handle proper instead of the above-described rotating ring or is located under the proximal end of the handle to be actuated by the material of the handle. The sensor (also called "touch sensor") records touching or touched motions of a finger of the user. If, for example, the thumb of the user is sliding over the sensor in the circumferential direction, an increase or decrease in the luminosity of the operating light is brought about, or, as an alternative, focusing is changed. The light can, for example, be switched on and off by a brief touching or by two short consecutive touches ("double clicks"). Position-dependent operation by left-handed and right-handed persons is possible without problems in this embodiment as well.

This second operating concept makes possible, furthermore, a menu function. Thus, the operating light can be switched on, for example, by a first "double click." Such a "double click" is preferably acknowledged by an acoustic signal. Immediately after being switched on, the operating light is, for example, at first in the focus mode, which makes possible the focusing of the light by the user moving his or her thumb over the sensor surface in the circumferential direction. The activation of this mode can be additionally displayed by an indicator (e.g., a blue LED). When the user performs another "double click," the light switches, for example, into the luminosity mode (displayed, e.g., by a yellow LED), which makes it possible to set the brightness of the light by the user again moving his thumb over the ring-shaped sensor surface in the circumferential direction. The user can change over to another function mode or return to the focus mode by a repeated "double click."

However, multifunctional operation of the operating light can also be achieved by the above-described touch-sensitive sensor operating in a direction-dependent manner. This means that the sensor or corresponding electronic control unit of the sensor recognizes whether the thumb is sliding on the sensor surface in the axial direction or in the circumferential direction. For example, focusing can be set by the user moving his or her thumb along the sensor surface in the axial direction, whereas the brightness of the light can be adjusted by a motion in the circumferential direction. A combined motion in the diagonal direction consequently brings about a simultaneous adjustment of the focus and luminosity.

It is obvious to the person skilled in the art that this operating concept makes possible various types of a multifunctional mode control. The above explanations are given as an example only and shall not be construed as representing limitations.

As was described at the beginning, the rotating ring or ring-shaped sensor element is arranged between the glass pane and handle. The rotating ring may be mechanically coupled, for example, with a potentiometer or a similar measuring transducer in the interior of the light housing, so that rotation of the rotating ring is converted into electric signals via the potentiometer, and these signals are sent to a control circuit. By contrast, electric signals are generated directly in the sensor element in case of the sensor element and can be transmitted to the control circuit.

The touch-sensitive sensor element is arranged nondetachably on the side of the light in or next to the inner grip and is covered by the handle and can thus be operated by the handle in a sterile manner.

The present invention will now be described on the basis of some exemplary embodiments with reference to the figures, on the basis of which various embodiments of the operating light according to the present invention will be explained. However, the present invention is not limited to these exemplary embodiments. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
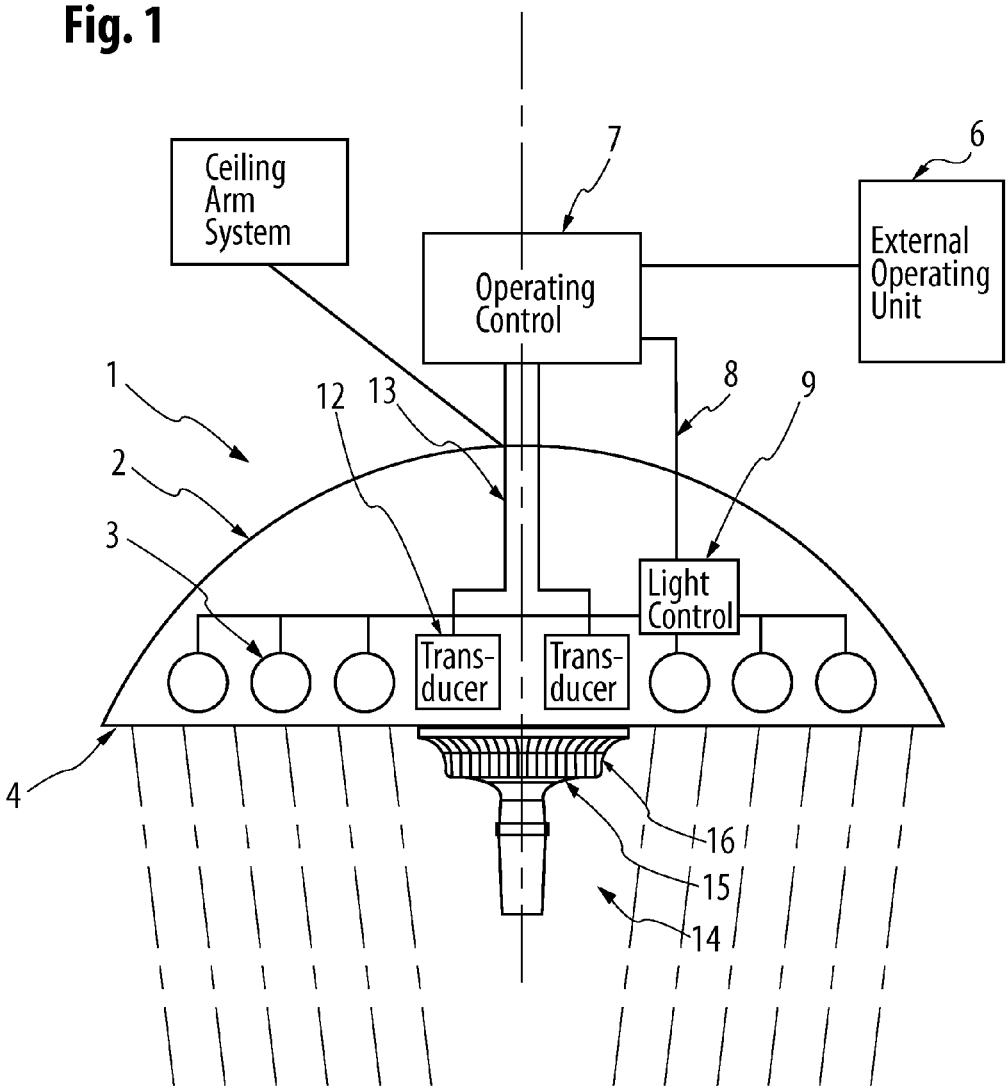
FIG. 1 is a detailed view of the operating light according to the invention.

Referring to the drawings in particular, FIG. 1 shows a detailed view of the operating light 1. The light 1 shown is mounted on a ceiling arm system, not shown, and has a housing 2, in which at least one light source 3 with corresponding optical systems is contained. A handle 5, which is rigidly connected to the housing 2 by means of an axle, is arranged nonrotatably on the underside of the housing 2 (approximately in the middle of the light exit opening 4). Furthermore, an external (nonsterile) operating unit 6, which is coupled with an operating control 7, which is located inside or outside the light housing 2, is provided outside the light housing 2. The operating control 7 is connected to a light control 9 via a control line 8. The operating control 7 and light control 9 together form the electronic control unit. As was explained above, handle 5 has an integrally designed, expanded area 10. A ring-shaped operating element 11, which is rotatable relative to handle 5 and to light housing 2, is arranged between this expanded area 10 and the light exit opening or pane 4. Both handle 5 and the rotatable, ring-shaped operating element 11 are sterilizable.

As was explained before, the physician or surgeon grasps the handle 5 with one hand to thus pivots the light. The physician can rotate with his free thumb the rotatable, ring-shaped operating element 11 to set, for example, the brightness of the light. The rotatable operating element 11 is coupled with one or more measuring transducers 12, which are designed to detect the angle of rotation or the direction of rotation of the rotating ring 11 and to transmit a signal corresponding to the angle of rotation or direction of rotation to the operating control 7 via signal lines 13. The operating control 7 does in turn send a corresponding signal via the control line 8 to the light control 9, by means of which the voltage or power supply to the at least one light source 3 is set.

Figure 2:
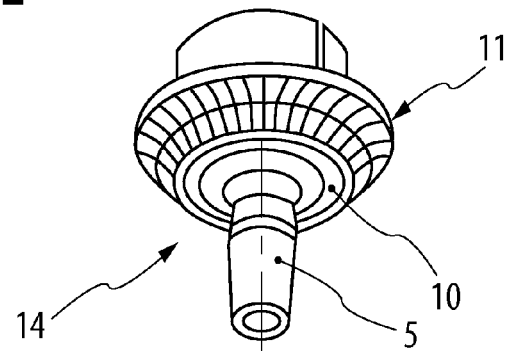
FIG. 2 is an enlarged view of the grip assembly unit of FIG. 1.

FIG. 2 shows an enlarged view of the grip assembly unit 14. The grip assembly unit 14 has a handle 5, which comprises a cylindrical grip area and an expanded area 10 adjoining same, which is made integrally with the grip area. Handle 5 is connected nonrotatably to the housing 2 of the operating light 1 via a fixed axle (not shown). A highly stable coupling is obtained as a result between the light housing 2 and handle 5, so that the user can grasp the handle 5 with one hand to displace the light, possibly together with an associated ceiling arm system, into a desired position. A ring-shaped operating element 11 is provided at the upper end of the expanded area 10 of handle 5.

According to a first embodiment, this ring-shaped operating element (rotating ring 11) is rotatable relative to the handle 5 and hence also relative to the light housing 2. As was explained above, it is possible to set, for example, the brightness of the light by rotating the rotating ring 11. As an alternative, it is also possible, however, to perform focusing of the light or other function settings by means of the rotating ring 11. To facilitate the rotation of the rotating ring 11 with the user's thumb (while the handle 5 is being held with the other fingers and the inner surface of the hand), the rotating ring 11 is, for example, fluted or provided with knobs or other surface elements on its surface. Both handle 5 and rotating ring 11 must be sterile and may consequently be touched by the operating physician or surgeon only. To make it possible to sterilize handle 5 and rotating ring 11, both parts can be removed separately. The axle of handle 5 may be provided for this with an outer axial profile, while the axle mounting opening of handle 5 is provided with a corresponding inner profile and locking means. Handle 5 can thus mesh with the axle, locking into same, axially displaceably but such that they rotate in unison. A sleeve may extend coaxially with the axle. This sleeve is provided with an outer axial profile, while the ring-shaped operating element 11 is provided with a corresponding profile and locking means in its inner passage opening. The ring-shaped operating element 11 can thus mesh with the sleeve, locking into same, axially displaceably but such that they rotate in unison. The sleeve with the ring-shaped operating element 11 and sleeve together with handle 5 can be rotated on the axle independently from one another. The rotary motion of operating element 11 and of handle 5 is analyzed in the electronic unit by means of potentiometer or switches, which strike stops in the sleeves. A possible variant is the use of a resolver at its rotatable operating element 11. The electronic control unit sends corresponding signals to set the brightness of the at least one light source or to perform other functions.

Figure 3A:
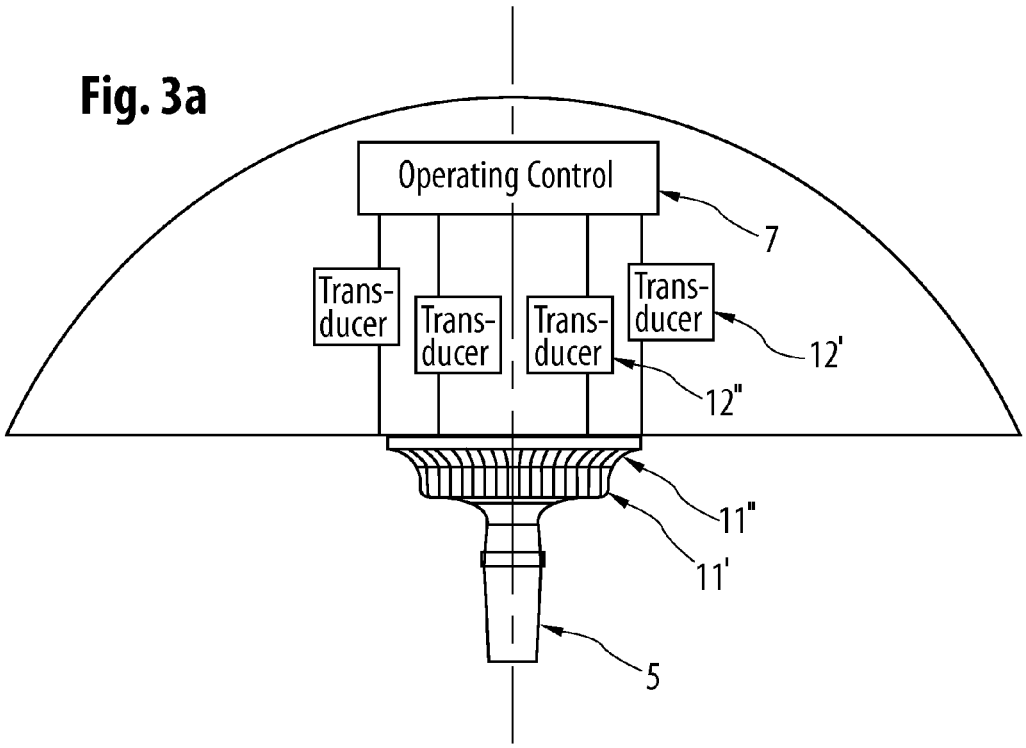
FIG. 3*a* is a detailed view of an alternative embodiment of the light from FIG. 1.

FIG. 3*a* shows a variant with two ring-shaped operating elements 11' and 11", which are arranged one on top of another and are rotatable similarly to ring-shaped operating element 11 in FIG. 1 and independently from one another. The respective angle of rotation or the "clicking" of the two operating elements 11', 11" are detected by corresponding measuring transducers 12', 12". The corresponding output signals of the measuring transducers 12', 12" are again sent to an operating control 7 here as well. For example, the brightness of the light can be set by means of the first ring-shaped operating element 11', while the focus of the light sources can be set with the second ring-shaped operating element 11". Other functions are also possible as an alternative.

Figure 3B:
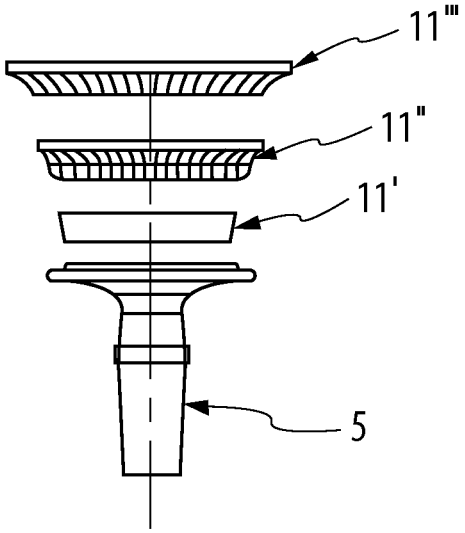
FIG. 3*b* is a detailed view of an alternative embodiment of the light from FIG. 1.

FIG. 3*b* shows another variant with three ring-shaped operating elements 11', 11" and 11'". The respective angles of rotation of the three ring-shaped operating elements 11', 11", 11' are detected by corresponding measuring transducers, as they are shown in FIG. 3*a*. It is obvious that four or more operating elements may be provided as well.

Figure 3C:
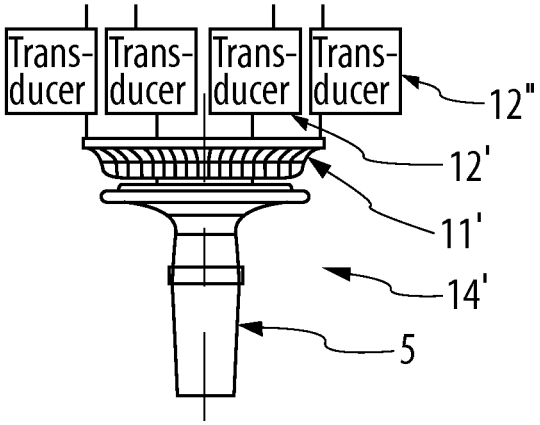
FIG. 3*c* is a detailed view of an alternative embodiment of the light from FIG. 1.

FIG. 3*c* shows yet another variant of the embodiments from FIGS. 3*a* and 3*b*. A rotatable, ring-shaped operating element 11, which functions in the same manner as the ring-shaped operating elements 11, 11', 11", 11' from FIGS. 1, 3*a* and 3*b*, is provided in FIG. 3*c*. The handle of the grip assembly unit 14' is rotatable in this variant, and the angle of rotation or the right/left stops ("clicks") of handle 5' and of ring-shaped operating element 11' are detected by corresponding measuring transducers 12' and 12".

Figure 4:
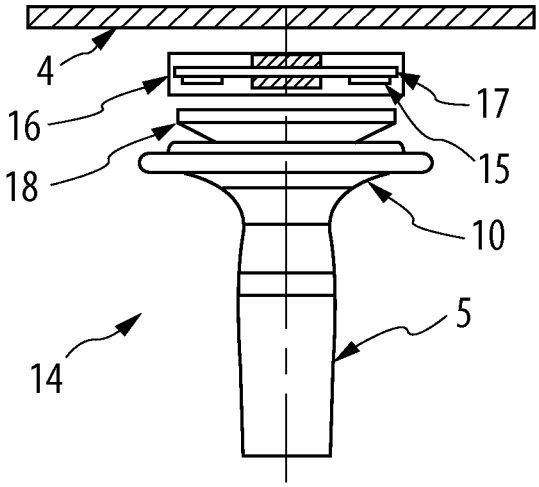
FIG. 4 is a side exploded view of a handle with touch-sensitive sensor element according to the invention.

FIG. 4 shows a possible embodiment of the grip assembly unit 14 according to the present invention together with a touch-sensitive sensor element 15 and handle 5.

According to an alternative embodiment of the present invention, ring-shaped operating element 11 may also be designed as a ring-shaped, touch-sensitive sensor element 15, which is nonrotatable relative to handle 5 and to light housing 2, but is covered in a sterile manner by handle 5, but above all by the expanded area 10. This functions because the sensor or sensor element 15 is also sensitive enough even through the material of handle 5 and can be activated. No fluting needs to be provided in this case on the outer surface of the ring-shaped operating element 11. The operating element 11 is designed, instead, as a touch sensor. When the user grasps handle 5 with his fingers and the inner surface of his or her hand, the user can touch the handle via the sensor surface with the thumb of the same hand to activate the sensor surface. Different functions can be performed depending on the type of touch and the type of the contact motion over the touch-sensitive sensor surface. For example, the light can be switched on or off by a single touching ("click") or by two brief consecutive touches ("double click"). Furthermore, the user's thumb can be moved on the sensor surface in the axial or circumferential direction. Depending on the direction of motion on the sensor surface, the light can be focused or the brightness of the light can be set.

Figure 5:
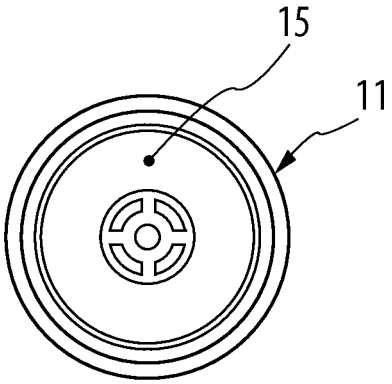
FIG. 5 is a top view of the handle with touch-sensitive sensor element from FIG. 4.

As was explained above, handle 5 is rigidly connected to light housing 2 via an axle, not shown. Handle 5 has an essentially cylindrical grip area and an expanded area 10, which adjoins same and is made integrally therewith. A board cover (board housing) 16, in which a sensor board 17 is provided, on which a touch-sensitive sensor element 15 is arranged, is arranged between handle 5 and light exit opening 4 of housing 2. The exact positioning and shape of the touch-sensitive sensor element 15 relative to the expanded area 10 of handle 5 is shown in FIG. 5. As is also apparent from FIG. 4, a body 18 made of a dielectric material is optionally located between the expanded area 10 of handle 5 and board cover 16.

FIG. 5 shows a top view of the touch-sensitive sensor element 15 from FIG. 4.

Figure 6A:
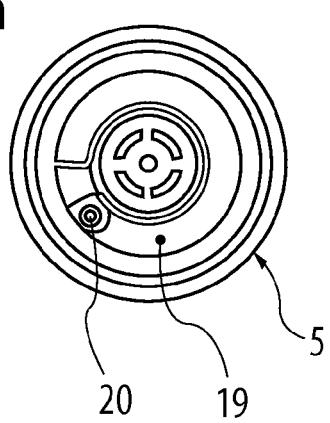
FIG. 6*a* is a bottom view showing an embodiment of a touch sensor according to the invention.
Figure 6B:
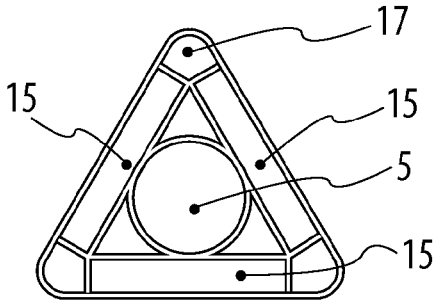
FIG. 6*b* is a bottom view showing an embodiment of a touch sensor according to the invention.

FIGS. 6*a* and 6*b* show two possible embodiments of the sensor surface of the operating element designed as a touch-sensitive sensor. The touch-sensitive sensor is designed in FIG. 6*a* as a semi-circular flexible board 19, which can be placed in a sterile manner under the conical areas of handle 5 and especially of expanded area 10.

A touch or click button 20 may be integrated at one end of the flexible board 19 to facilitate menu navigation. However, as was explained above, the same function can also be brought about by a "double click" at any point of the partial circular flexible board 19.

FIG. 6*b* shows another alternative embodiment of the touch-sensitive sensor element 15. The touch-sensitive sensor comprises in this embodiment three linear areas 15, which are arranged in a triangular pattern and surround the axle of handle 5. The expanded area 10 of handle 5 should likewise be triangular in this case to cover the sensor surfaces. This arrangement has the advantage that linear sensors can be used, which can be manufactured and installed in a simpler manner. Due to the shape of the arrangement, the user knows immediately where the position of the touch-sensitive sensor elements 15 is. The design in the form of other polygons is possible as well.

Figure 7:
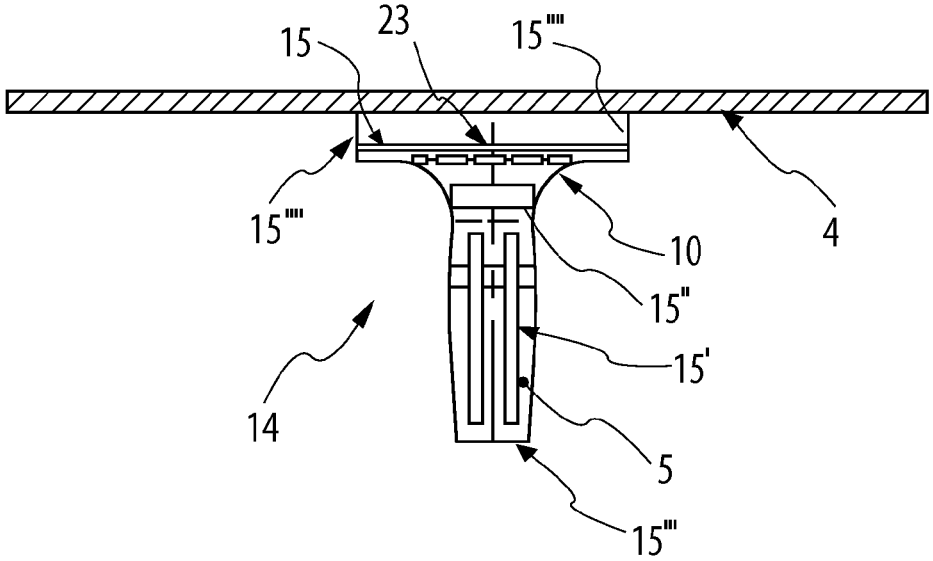
FIG. 7 is a view showing various other alternative embodiments of a grip assembly unit with touch-sensitive sensor surfaces.

FIG. 7 shows other possible positions, at which touch-sensitive sensor element 15 can be arranged as an alternative to the embodiment according to the preceding figures. This may be in the cylindrical area of handle 5 (15'), or in the transition area between handle 5 and expanded area 10 (15") or at the open end of handle 5 (15') or in the outer area of expanded area 10 cylindrically under handle (15""). Other positions are conceivable.

While specific embodiments of the invention have been shown and described in detail to illustrate the application of the principles of the invention, it will be understood that the invention may be embodied otherwise without departing from such principles.

LIST OF REFERENCE NUMBERS

1 Operating light
2 Light housing, housing of operating light
3 Light source
4 Light exit opening or pane
5 Handle
6 External operating unit
7 Operating control
8 Control line
9 Light control
10 Expanded area of handle
11 Ring-shaped operating element, rotating ring
12 Measuring transducer
13 Signal lines
14 Grip assembly unit
15 Touch-sensitive sensor element
16 Board cover, board housing
17 Sensor board
18 Body made of dielectric material
19 Flexible board
20 Clicking button

What is claimed is:

1. An operating light comprising:
a housing with a light exit opening;
a ceiling arm system coupled with the housing to movably hold the operating light;
at least one light source arranged in the housing;
at least one corresponding optical system arranged in the housing, the at least one corresponding optical system directing light emitted by the at least one light source in a direction of the light exit opening; and
a grip assembly unit provided approximately in a middle of the light exit opening, the grip assembly unit comprising a handle to pivot the operating light into a desired position, at least one rotating ring located between the handle and the housing, the at least one rotating ring comprising an annular outer contact surface that is rotatable in relation to the handle and setting one or more functions of the operating light and another rotating ring to provide two or more rotating rings arranged one on top of another, the another rotating ring being rotatable independently from the at least one rotating ring with each of the at least one rotating ring and the another rotating ring being rotatable to generate electric signals of their own for controlling different functions of the operating light.

2. An operating light in accordance with claim 1, wherein at least one of the handle and the rotating ring can be removed, sterilized and replaced with a replacement rotating ring or handle.

3. An operating light in accordance with claim 1, wherein additionally the handle and the rotating ring are provided with a removable sterile cover in the form of a cap or protective cover.

4. An operating light in accordance with claim 1, wherein the at least one rotating ring is coupled with a potentiometer, a relative incremental transducer or a measuring transducer, which is designed to generate a corresponding electric signal by rotating the rotating ring.

5. An operating light in accordance with claim 1, wherein the at least one rotating ring cooperates with a contact responsive switch and is rotatable by a small angle in a clockwise and counterclockwise direction against the contact responsive switch to generate a signal, which brings about an incremental increase or decrease in an electric value.

6. An operating light in accordance with claim 1, wherein:
the two or more rotating rings provide rings arranged one on top of another; and
the handle is additionally also arranged rotatably and equipped with rotation sensors to likewise generate electric signals for controlling a function of the light.

7. An operating light in accordance with claim 1, wherein the at least one rotating ring is provided with a plurality of fluted recessed grips or knobs.

8. An operating light comprising:
a housing with a light exit area;
a ceiling arm system coupled with the housing to hold the housing movably;
at least one light source arranged in housing;
at least one corresponding optical system arranged in housing to direct light emitted by the at least one light source in the direction of the light exit area;
a grip assembly unit provided approximately in the middle of the light exit area, the grip assembly unit having a handle to grasp and pivot the operating light into a desired position and at least one capacitive touch-sensitive sensor element located between the handle and the housing, the touch-sensitive sensor element detecting a touch with one or several fingers of a user directly or through a thin cover of the touch-sensitive sensor element to set at least one function of the operating light.

9. An operating light in accordance with claim 8, wherein a sensor surface of the touch-sensitive sensor element comprises a flexible board or semiflex board.

10. An operating light in accordance with claim 8, wherein the at least one touch-sensitive sensor element additionally has a touch or click button.

11. An operating light in accordance with claim 8, wherein the at least one touch-sensitive sensor element is covered in a sterile manner by the handle or expanded area of the handle, wherein the handle or parts thereof are replaceable parts, removable and sterilizable.

12. An operating light in accordance with claim 8, further comprising a removable sterile cover wherein the touch-sensitive sensor element is covered in a sterile manner by the removable sterile cover in the form of a cap or protective cover.

13. An operating light in accordance with claim 8, wherein the at least one touch-sensitive sensor element is arranged radially, conically or as a single sensor element or a plurality of sensor elements linearly under the handle or expanded area thereof or cylindrically under the side, under the tip or under the bottom edge of the handle or in the inner grip under the handle.

14. An operating light in accordance with claim 8, wherein a luminosity and/or focusing of the at least one light source is changed by a user moving a finger of the user close to the touch-sensitive sensor element.

15. An operating light in accordance with claim 8, wherein the touch-sensitive sensor operates in a direction-dependent manner and detects a motion of one or more fingers in a linear, radial and/or axial direction.

16. An operating light in accordance with claim 8, wherein the capacitive touch-sensitive sensor element comprises one ofmore touch responsive surfaces that together encircle the handle.

17. An operating light in accordance with claim 16, wherein the capacitive touch-sensitive sensor element comprises an annular touch responsive surface.

18. An operating light in accordance with claim 16, wherein the capacitive touch-sensitive sensor element comprises three or more linear areas arranged in a pattern surrounding an axis of the handle.

19. An operating light comprising:

a housing with a light exit opening;

a ceiling arm system coupled with the housing to movably hold the operating light;

at least one light source arranged in the housing;

at least one corresponding optical system arranged in the housing, the at least one corresponding optical system directing light emitted by the at least one light source in a direction of the light exit opening; and a grip assembly unit provided approximately in a middle of the light exit opening, the grip assembly unit comprising a handle to pivot the operating light into a desired position, and at least one rotating ring located between the handle and the housing, the at least one rotating ring, being rotatable in relation to the handle and setting one or more functions of the operating light, wherein the at least one rotating ring cooperates with a contact responsive switch and is rotatable by a small angle in a clockwise and counterclockwise direction against the contact responsive switch to generate a signal, which brings about an incremental increase or decrease in an electric value.

* * * * *